US008053150B2

(12) United States Patent
Wu

(10) Patent No.: US 8,053,150 B2
(45) Date of Patent: Nov. 8, 2011

(54) THIOBIS(THIOFORMATE) CONTAINING PHOTOCONDUCTORS

(75) Inventor: Jin Wu, Webster, NY (US)

(73) Assignee: Xerox Corporation, Norwalk, CT (US)

( * ) Notice: Subject to any disclaimer, the term of this patent is extended or adjusted under 35 U.S.C. 154(b) by 626 days.

(21) Appl. No.: 12/212,091

(22) Filed: Sep. 17, 2008

(65) Prior Publication Data

US 2010/0068637 A1 Mar. 18, 2010

(51) Int. Cl.
*G03G 5/047* (2006.01)

(52) U.S. Cl. ..... 430/58.8; 430/58.05; 430/59.1; 430/58.75

(58) Field of Classification Search ..... 430/58.05, 430/58.8, 58.75, 59.1
See application file for complete search history.

(56) References Cited

U.S. PATENT DOCUMENTS

| | | | | |
|---|---|---|---|---|
| 4,265,990 | A | 5/1981 | Stolka et al. | |
| 4,555,463 | A | 11/1985 | Hor et al. | |
| 4,587,189 | A | 5/1986 | Hor et al. | |
| 5,459,005 | A * | 10/1995 | Kato et al. | 430/95 |
| 5,473,064 | A | 12/1995 | Mayo et al. | |
| 5,482,811 | A | 1/1996 | Keoshkerian et al. | |
| 5,521,306 | A | 5/1996 | Burt et al. | |
| 2010/0068638 | A1 | 3/2010 | Wu | |

OTHER PUBLICATIONS

Jin Wu, U.S. Appl. No. 12/164,596 on Bis(Enylaryl)Arylamine Containing Photoconductors, filed Jun. 30, 2008.
Jin Wu et al., U.S. Appl. No. 12/164,338 on Phenolic Resin Hole Blocking Layer Photoconductors, filed Jun. 30, 2008.
Jin Wu, U.S. Appl. No. 12/164,549 on Tris(Enylaryl)Amine Containing Photoconductors, filed Jun. 30, 2008.
Jin Wu, U.S. App. No. 12/164,658 on Tris And Bis(Enylaryl)Arylamine Mixtures Containing Photoconductors, filed Jun. 30, 2008.
Jin Wu, U.S. Appl. No. 12/164,701 on (Enylaryl)Bisarylamine Containing Photoconductors, filed Jun. 30, 2008.
Jin Wu et al., U.S. Appl. No. 12/112,206 on Metal Mercaptoimidazoles Containing Photoconductors, filed Apr. 30, 2008.
Jin Wu et al., U.S. Appl. No. 12/059,587 on Titanocene Containing Photoconductors, filed Mar. 31, 2008.
Jin Wu et al., U.S. Appl. No. 12/059,573 on Oxadiazole Containing Photoconductors, filed Mar. 31, 2008.

* cited by examiner

*Primary Examiner* — Christopher Rodee
(74) *Attorney, Agent, or Firm* — Oliff & Berridge, PLC

(57) ABSTRACT

A photoconductor that includes, for example, a supporting substrate, a photogenerating layer, and a thiobis(thioformate) containing charge transport layer; a thiobis(thioformate) containing photogenerating layer, or where both at least one charge transport layer and the photogenerating layer includes, in addition to other components, a thiobis(thioformate).

32 Claims, No Drawings

THIOBIS(THIOFORMATE) CONTAINING PHOTOCONDUCTORS

CROSS REFERENCE TO RELATED APPLICATIONS

Copending U.S. application Ser. No. 12/212,057, U.S. Publication 20100068638, filed Sep. 17, 2008, entitled Zinc Dithiol Containing Photoconductors, the disclosure of which is totally incorporated herein by reference, illustrates a photoconductor comprising a photogenerating layer, and at least one charge transport layer containing a charge transport component, and wherein at least one of the photogenerating layer and at least one of the charge transport layers includes a zinc dithiol.

U.S. application Ser. No. 12/164,596, now U.S. Pat. No. 7,968,262, filed Jun. 30, 2008, the disclosure of which is totally incorporated herein by reference, illustrates a photoconductor comprising a photogenerating layer, and at least one charge transport layer wherein at least one of the charge transport layers is comprised of at least one charge transport component, and a bis(enylaryl)arylamine.

Copending U.S. application Ser. No. 12/164,338, U.S. Publication 20090325090, filed Jun. 30, 2008, the disclosure of which is totally incorporated herein by reference, illustrates a photoconductor comprising a substrate, a ground plane layer, an undercoat layer thereover wherein the undercoat layer comprises an aminosilane and a phenolic resin, a photogenerating layer, and a charge transport layer.

Copending U.S. application Ser. No. 12/164,549, U.S. Publication 20090325096, filed Jun. 30, 2008, the disclosure of which is totally incorporated herein by reference, illustrates a photoconductor comprising an optional supporting substrate, a photogenerating layer, and at least one charge transport layer wherein at least one of the charge transport layers is comprised of at least one charge transport component, and a tris(enylaryl)amine.

U.S. application Ser. No. 12/164,658, now U.S. Pat. No. 7,981,580, filed Jun. 30, 2008, the disclosure of which is totally incorporated herein by reference, illustrates a photoconductor comprising a photogenerating layer, and at least one charge transport layer wherein at least one of the charge transport layers is comprised of at least one charge transport component, and a mixture of a tris(enylaryl)amine and a bis(enylaryl)arylamine.

Copending U.S. application Ser. No. 12/164,701, U.S. Publication 20090325093, filed Jun. 30, 2008, the disclosure of which is totally incorporated herein by reference, illustrates a photoconductor comprising an optional supporting substrate, a photogenerating layer, and a charge transport layer comprised of at least one charge transport component, and an (enylaryl)bisarylamine.

In U.S. application Ser. No. 12/112,206, now U.S. Pat. No. 7,989,126, filed Apr. 30, 2008, the disclosure of which is totally incorporated herein by reference, there is illustrated a photoconductor comprising an optional supporting substrate, a photogenerating layer, and at least one charge transport layer wherein at least one of the charge transport layers is comprised of at least one charge transport component, and wherein at least one of the photogenerating layer and the charge transport layer includes a metal mercaptoimidazole.

In U.S. application Ser. No. 12/059,587, now U.S. Pat. No. 7,811,732, filed Mar. 31, 2008, the disclosure of which is totally incorporated herein by reference, there is illustrated a photoconductor comprising an optional supporting substrate, a photogenerating layer, and at least one charge transport layer wherein at least one of the charge transport layers is comprised of at least one charge transport component, and wherein at least one of the photogenerating layer and the charge transport layer includes a titanocene.

In U.S. application Ser. No. 12/059,573, now U.S. Pat. No. 7,960,080, filed Mar. 31, 2008, the disclosure of which is totally incorporated herein by reference, there is illustrated a photoconductor comprising an optional supporting substrate, a photogenerating layer, and at least one charge transport layer wherein at least one of the charge transport layers is comprised of at least one charge transport component, and where at least one of the photogenerating layer and the charge transport layer includes an oxadiazole.

A number of the components and amounts thereof of the above copending applications, such as the supporting substrates, resin binders, photogenerating layer components, antioxidants, charge transport components, hole blocking layer components, adhesive layers, and the like, may be selected for the photoconductors of the present disclosure in embodiments thereof.

BACKGROUND

This disclosure is generally directed to photoconductors, and imaging and printing processes thereof. More specifically, in embodiments the present disclosure is directed to rigid, multilayered flexible belt imaging members, drum photoconductors, or devices comprised of an optional supporting medium like a substrate, at least one of a photogenerating layer and a charge transport layer, including a first charge transport layer and a second charge transport layer, containing an additive of a thiobis(thioformate), an optional adhesive layer, an optional hole blocking or undercoat layer, and an optional overcoating layer. At least one in embodiments refers, for example, to 1, to from 1 to about 10, to from 2 to about 7; to from 2 to about 4, to 2, and the like. Moreover, the thiobis(thioformate) can be physically added to at least one of the charge transport layers and, for example, instead of being dissolved in the charge transport layer solution, the thiobis (thioformate) can be added to the charge transport mixture as a dopant.

Yet more specifically, there is disclosed a photoconductor comprised of a supporting substrate, a thiobis(thioformate) containing photogenerating layer, and/or a thiobis(thioformate) containing charge transport layer or charge transport layers, such as a first pass charge transport layer, and a second pass charge transport layer, or both the first and second pass charge transport layers to primarily permit excellent ghosting characteristics; excellent photoconductor photosensitivities and an acceptable, and in embodiments, a low $V_r$, and minimization or prevention of $V_r$ cycle up.

Also disclosed are methods of imaging and printing with the photoconductor devices illustrated herein. These methods generally involve the formation of an electrostatic latent image on the imaging member, followed by developing the image with a toner composition comprised, for example, of thermoplastic resin, colorant, such as pigment, charge additive, and surface additive, reference U.S. Pat. Nos. 4,560,635; 4,298,697, and 4,338,390, the disclosures of which are totally incorporated herein by reference, subsequently transferring the image to a suitable substrate, and permanently affixing the image thereto. In those environments wherein the device is to be used in a printing mode, the imaging method involves the same operation with the exception that exposure can be accomplished with a laser device or image bar. More specifically, flexible belts disclosed herein can be selected for the Xerox Corporation iGEN3® and subsequent related machines that generate with some versions over 100 copies per minute. Processes of imaging, especially xerographic imaging and printing, including digital, and/or color printing, are thus encompassed by the present disclosure. The imaging members are, in embodiments, sensitive in the wavelength region of, for example, from about 400 to about 900 nanometers, and in particular from about 650 to about 850 nanometers, thus diode lasers can be selected as the light source. Moreover, the imaging members of this disclosure are useful in high resolution color xerographic applications, particularly high speed color copying and printing processes.

REFERENCES

Layered photoconductors are known and many of these photoconductors have been disclosed in the prior art, however, there continues to be a need for new and improved photoconductors, especially with regard to their use in high speed printing, such as at least about 100 prints per minute, and wherein ghosting characteristics are minimized and, in embodiments, substantially eliminated.

Layered photoconductors have been described in numerous U.S. patents, such as U.S. Pat. No. 4,265,990, wherein there is illustrated a photoconductor member comprised of a photogenerating layer, and a hole transport layer.

Further, in U.S. Pat. No. 4,555,463 there is illustrated a layered imaging member with a chloroindium phthalocyanine photogenerating layer. In U.S. Pat. No. 4,587,189 there is illustrated a layered imaging member with, for example, a perylene pigment photogenerating component. Both of the aforementioned patents disclose an aryl amine component, such as N,N'-diphenyl-N,N'-bis(3-methylphenyl)-1,1'-biphenyl-4,4'-diamine dispersed in a polycarbonate binder as a hole transport layer. The above components, such as the photogenerating compounds and the aryl amine charge transport, can be selected for the imaging members of the present disclosure in embodiments thereof.

Illustrated in U.S. Pat. No. 5,521,306, the disclosure of which is totally incorporated herein by reference, is a process for the preparation of Type V hydroxygallium phthalocyanine comprising the in situ formation of an alkoxy-bridged gallium phthalocyanine dimer, hydrolyzing the dimer to hydroxygallium phthalocyanine, and subsequently converting the hydroxygallium phthalocyanine product to Type V hydroxygallium phthalocyanine and the selection thereof as photogenerating pigments in photoconductors.

Illustrated in U.S. Pat. No. 5,482,811, the disclosure of which is totally incorporated herein by reference, is a photoconductor containing a pigment of a hydroxygallium phthalocyanine and where the hydroxygallium phthalocyanine is prepared by hydrolyzing a gallium phthalocyanine precursor pigment by dissolving the hydroxygallium phthalocyanine in a strong acid, and then reprecipitating the resulting dissolved pigment in basic aqueous media; removing any ionic species formed by washing with water; concentrating the resulting aqueous slurry comprised of water and hydroxygallium phthalocyanine to a wet cake; removing water from said slurry by azeotropic distillation with an organic solvent, and subjecting said resulting pigment slurry to mixing with the addition of a second solvent to cause the formation of said hydroxygallium phthalocyanine polymorphs.

Also, reference is made to U.S. Pat. No. 5,473,064, the disclosure of which is totally incorporated herein by reference, where there is illustrated a process for the preparation of photogenerating pigments of hydroxygallium phthalocyanine and the incorporation of these pigments in a photoconductor. Yet more specifically, this patent discloses a process for the preparation of hydroxygallium phthalocyanine Type V essentially free of chlorine, where a pigment precursor Type I chlorogallium phthalocyanine is prepared by the reaction of gallium chloride in a solvent, such as N-methylpyrrolidone, present in an amount of from about 10 parts to about 100 parts, with 1,3-diiminoisoindolene ($DI^3$) in an amount of from about 1 part to about 10 parts, for each part of gallium chloride that is reacted; hydrolyzing said pigment precursor chlorogallium phthalocyanine Type I by standard methods, for example acid pasting, whereby the pigment precursor is dissolved in concentrated sulfuric acid and then reprecipitated in a solvent, such as water, or a dilute ammonia solution, for example from about 10 to about 15 percent; and subsequently treating the resulting hydrolyzed pigment hydroxygallium phthalocyanine Type I with a solvent, such as N,N-dimethylformamide, present in an amount of from about 1 volume part to about 50 volume parts, for each weight part of pigment hydroxygallium phthalocyanine that is used by, for example, ball milling the Type I hydroxygallium phthalocyanine pigment in the presence of spherical glass beads, approximately 1 millimeter to 5 millimeters in diameter, at room temperature, about 25° C., for a period of from about 12 hours to about 1 week, and more specifically, about 24 hours.

The appropriate components and processes of the above recited patents may be selected for the present disclosure in embodiments thereof.

SUMMARY

Disclosed in embodiments are photoconductors with many of the advantages illustrated herein, such as excellent and reduced or low image ghosting characteristics; fast transport; extended lifetimes of service of, for example, in excess of about 1,000,000 xerographic imaging cycles; excellent electrical characteristics; stable electrical properties; low background; consistent $V_r$ (residual potential), that is substantially flat or no change over a number of imaging cycles as illustrated by the generation of known PIDCs (Photoinduced Discharge Curve), and the like. Also disclosed are layered photoresponsive imaging members which are responsive to visible light and to near infrared radiation of from about 700 to about 900 nanometers.

Additionally disclosed are flexible imaging members with optional hole blocking layers comprised of metal oxides, phenolic resins, and optional phenolic compounds, and which phenolic compounds contain at least two, and more specifically, two to ten phenol groups or phenolic resins with, for example, a weight average molecular weight ranging from about 500 to about 3,000 permitting, for example, a hole blocking layer with excellent efficient electron transport which usually results in a desirable photoconductor low residual potential $V_{low}$.

EMBODIMENTS

Aspects of the present disclosure relate to a photoconductor comprising an optional supporting substrate, a photogenerating layer, and at least one charge transport layer comprised of at least one charge transport component, and where the photogenerating layer, charge transport layer, or both the photogenerating layer and charge transport layer contains a thiobis(thioformate) additive; a photoconductor comprising a supporting substrate, a photogenerating layer, and at least one charge transport layer, and wherein the charge transport layer contains a thiobis(thioformate); a photoconductor comprised in sequence of a supporting substrate, a photogenerating layer, and a charge transport layer, and wherein the photogenerating layer contains a thiobis(thioformate); a photoconductor comprising a photogenerating layer comprised of a photogenerating pigment and a polymeric binder, and at least one charge transport layer containing a charge transport component, and a polymeric binder, and wherein at least one of the photogenerating layers and at least one of the charge transport layers, such as 1, 2, or 3 layers, includes in addition to other appropriate components a thiobis(thioformate); a photoconductor comprising a supporting substrate, a photogenerating layer, and at least one charge transport layer, and wherein the charge transport layer contains hole transport molecules, a resin binder, and a thiobis(thioformate); a photoconductor comprised in sequence of a photogenerating layer, and a charge transport layer, and wherein the photogenerating layer contains a thiobis(thioformate) present in an amount of, for example, from about 1 to about 15, from about 5 to about 10, or more specifically, about 5 weight percent; a photoconductor comprising a photogenerating layer, and at least one charge transport layer, such as 2, 3, or 4 layers, containing a charge transport component, and wherein at least one of the photogenerating layer and at least one of the charge transport layers, includes a thiobis(thioformate). In addition to the thiobis(thioformate), the photogenerating layer is usually comprised of at least one photogenerating pigment, and an optional polymer, and the at least one charge transport layer is comprised of a hole transport compound and a polymeric binder.

Example of Layer Additives

Various effective amounts of the thiobis(thioformate) can be included in the photogenerating layer, the charge transport layer, especially the first pass charge transport layer, or both the photogenerating layer and the charge transport layer, and which amounts are, for example, from about 0.1 to about 30 weight percent, from about 0.3 to about 10 weight percent, from about 0.4 to about 7 weight percent, from about 0.05 to about 20 weight percent, from about 0.2 to about 5, from about 0.1 to about 12, and from about 0.4 to about 1 weight percent. In embodiments, the amount of the thiobis(thioformate) that can be included in the photogenerating layer is from about 1 to about 30 weight percent, or from about 3 to about 20 weight percent; the amount of the thiobis(thioformate) that can be included in the charge transport layer is from about 0.1 to about 10 weight percent, or from about 0.3 to about 2 weight percent; and the amount of the thiobis (thioformate) that can be included in both the photogenerating layer and the charge transport layer is from about 0.1 to about 30 weight percent, or from about 0.3 to about 20 weight percent.

Examples of additives included in the photogenerating layer, at least one charge transport layer, or the photogenerating layer, and at least one charge transport layer are represented by or encompassed by the following formulas/structures

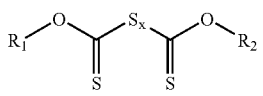

wherein x represents the number of sulfur atoms, such as for example, from about 1 to about 8, from about 2 to about 8, from about 2 to about 4, and the like, and wherein each R group is independently alkyl, especially lower alkyl with, for example, from 1 to about 6 carbon atoms, alkoxy, aryl and the like. Alkyl and alkoxy contain, for example, from 1 to about 28, from 1 to about 18, from 1 to about 12, and from 1 to about 6 carbon atoms, while aryl contains, for example, from 6 to about 42, from 6 to about 36, from 6 to about 24, and from 6 to about 18 carbon atoms. Specific examples of thiobis(thioformate)s are O,O-diisopropyl dithiobis(thioformate), isopropylxanthic disulfide, O,O-di(1-methylethyl)trithiobis (thioformate), O,O-di(1-methylethyl)tetrathiobis (thioformate), O,O-di(1-methylethyl)pentathiobis (thioformate), O,O-diethyl dithiobis(thioformate), O,O-dimethyl dithiobis(thioformate), diisopropyl xanthogen polysulfide, dibutyl xanthogen disulfide, and the like, and mixtures thereof.

In embodiments, the thiobis additive can be represented by the following

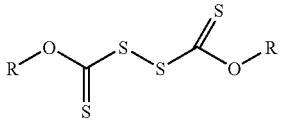

wherein R is alkyl, especially lower alkyl, that contains from 1 to about 6 carbon atoms, and yet more specifically, where R is isopropyl.

Photoconductor Layers

There can be selected for the photoconductors disclosed herein a number of known layers, such as substrates, photogenerating layers, charge transport layers, hole blocking layers, adhesive layers, protective overcoat layers, and the like. Examples, thicknesses, specific components of many of these layers include the following.

A number of known supporting substrates can be selected for the photoconductors illustrated herein, such as those substrates that will permit the layers thereover to be effective. The thickness of the substrate layer depends on many factors, including economical considerations, electrical characteristics, and the like, thus this layer may be of a substantial thickness, for example over 3,000 microns, such as from about 1,000 to about 3,500, from about 1,000 to about 2,000, from about 300 to about 700 microns, or of a minimum thickness of, for example, about 100 to about 500 microns. In embodiments, the thickness of this layer is from about 75 to about 300 microns, or from about 100 to about 150 microns.

The substrate may be comprised of a number of different materials, such as those that are opaque or substantially transparent, and may comprise any suitable material. Accordingly, the substrate may comprise a layer of an electrically nonconductive or conductive material, such as an inorganic or an organic composition. As electrically nonconducting materials, there may be employed various resins known for this purpose including polyesters, polycarbonates, polyamides, polyurethanes, and the like, which are flexible as thin webs. An electrically conducting substrate may be any suitable metal of, for example, aluminum, nickel, steel, copper, and the like, or a polymeric material, as described above, filled with an electrically conducting substance, such as carbon, metallic powder, and the like, or an organic electrically conducting material. The electrically insulating or conductive substrate may be in the form of an endless flexible belt, a web, a rigid cylinder, a sheet, and the like. The thickness of the substrate layer depends on numerous factors, including strength desired and economical considerations. For a drum, this layer may be of a substantial thickness of, for example, up to many centimeters, or of a minimum thickness of less than a millimeter. Similarly, a flexible belt may be of a substantial thickness of, for example, about 250 microns, or of a minimum thickness of less than about 50 microns, provided there are no adverse effects on the final electrophotographic device. In embodiments where the substrate layer is not conductive, the surface thereof may be rendered electrically conductive by an electrically conductive coating. The conductive coating may vary in thickness over substantially wide ranges depending upon the optical transparency, degree of flexibility desired, and economic factors.

Illustrative examples of substrates are as illustrated herein, and more specifically, layers selected for the imaging members of the present disclosure, and which substrates can be opaque or substantially transparent comprise a layer of insulating material including inorganic or organic polymeric materials, such as MYLAR® a commercially available polymer, MYLAR® containing titanium, a layer of an organic or inorganic material having a semiconductive surface layer, such as indium tin oxide or aluminum arranged thereon, or a conductive material inclusive of aluminum, chromium, nickel, brass, or the like. The substrate may be flexible, seamless, or rigid, and may have a number of many different configurations, such as for example, a plate, a cylindrical drum, a scroll, an endless flexible belt, and the like. In embodiments, the substrate is in the form of a seamless flexible belt. In some situations, it may be desirable to coat on the back of the substrate, particularly when the substrate is a flexible organic polymeric material, an anticurl layer, such as for example, polycarbonate materials commercially available as MAKROLON®.

The photogenerating layer, in embodiments, is comprised of an optional binder, and known photogenerating pigments, and more specifically, hydroxygallium phthalocyanine, titanyl phthalocyanine, and chlorogallium phthalocyanine, and a resin binder. Generally, the photogenerating layer can contain known photogenerating pigments, such as metal phthalocyanines, metal free phthalocyanines, alkylhydroxyl gallium phthalocyanines, hydroxygallium phthalocyanines, chlorogallium phthalocyanines, perylenes, especially bis(benzimidazo)perylene, titanyl phthalocyanines, and the like, and more specifically, vanadyl phthalocyanines, Type V hydroxygallium phthalocyanines, and inorganic components, such as selenium, selenium alloys, and trigonal selenium. The photogenerating pigment can be dispersed in a resin binder similar to the resin binders selected for the charge transport layer, or alternatively no resin binder need be present. Generally, the thickness of the photogenerating layer depends on a number of factors, including the thicknesses of the other layers, and the amount of photogenerating material contained in the photogenerating layer. Accordingly, this layer can be of a thickness of, for example, from about 0.05 to about 10 microns, and more specifically, from about 0.25 to about 2 microns when, for example, the photogenerating compositions are present in an amount of from about 30 to about 75 percent by volume. The maximum thickness of this layer in embodiments is dependent primarily upon factors, such as photosensitivity, electrical properties, and mechanical considerations. The photogenerating layer binder resin is present in various suitable amounts, for example from about 1 to about 50 weight percent, and more specifically, from about 1 to about 10 weight percent, and which resin may be selected from a number of known polymers, such as poly(vinyl butyral), poly(vinyl carbazole), polyesters, polycarbonates, polyarylates, poly(vinyl chloride), polyacrylates and methacrylates, copolymers of vinyl chloride and vinyl acetate, phenolic resins, polyurethanes, poly(vinyl alcohol), polyacrylonitrile, polystyrene, other known suitable binders, and the like. It is desirable to select a coating solvent that does not substantially disturb or adversely affect the previously coated layers of the device. Examples of coating solvents for the photogenerating layer are ketones, alcohols, aromatic hydrocarbons, halogenated aliphatic hydrocarbons, silanols, amines, amides, esters, and the like. Specific solvent examples are cyclohexanone, acetone, methyl ethyl ketone, methanol, ethanol, butanol, amyl alcohol, toluene, xylene, chlorobenzene, carbon tetrachloride, chloroform, methylene chloride, trichloroethylene, dichloroethane, tetrahydrofuran, dioxane, diethyl ether, dimethyl formamide, dimethyl acetamide, butyl acetate, ethyl acetate, methoxyethyl acetate, and the like.

The photogenerating layer may comprise amorphous films of selenium and alloys of selenium and arsenic, tellurium, germanium, and the like; hydrogenated amorphous silicon; and compounds of silicon and germanium, carbon, oxygen, nitrogen, and the like fabricated by vacuum evaporation or deposition. The photogenerating layers may also comprise inorganic pigments of crystalline selenium and its alloys; Groups II to VI compounds; and organic pigments, such as quinacridones, polycyclic pigments, such as dibromo anthanthrone pigments, perylene and perinone diamines, polynuclear aromatic quinones, azo pigments including bis-, tris- and tetrakis-azos; and the like dispersed in a film forming polymeric binder, and fabricated by solvent coating techniques.

Moreover, the photogenerating layer can be comprised of a photogenerating pigment that is of high value with regard to achieving a number of the advantages illustrated herein, which pigment is a titanyl phthalocyanine component generated, for example, by the processes as illustrated in copending application U.S. application Ser. No. 10/992,500, U.S. Publication No. 20060105254 (Attorney Docket No. 20040735-US-NP), the disclosure of which is totally incorporated herein by reference.

A number of titanyl phthalocyanines, or oxytitanium phthalocyanines are suitable photogenerating pigments known to absorb near infrared light around 800 nanometers, and may exhibit improved sensitivity compared to other pigments, such as, for example, hydroxygallium phthalocyanine. Generally, titanyl phthalocyanine is known to have five main crystal forms known as Types I, II, III, X, and IV. For example, U.S. Pat. Nos. 5,189,155 and 5,189,156, the entire disclosures of which are incorporated herein by reference, disclose a number of methods for obtaining various polymorphs of titanyl phthalocyanine. Additionally, U.S. Pat. Nos. 5,189,155 and 5,189,156 are directed to processes for obtaining Types I, X, and IV phthalocyanines. U.S. Pat. No. 5,153,094, the entire disclosure of which is incorporated herein by reference, relates to the preparation of titanyl phthalocyanine polymorphs including Types I, II, III, and IV polymorphs. U.S. Pat. No. 5,166,339, the disclosure of which is totally incorporated herein by reference, discloses processes for preparing Types I, IV, and X titanyl phthalocyanine polymorphs, as well as the preparation of two polymorphs designated as Type Z-1 and Type Z-2.

To obtain a titanyl phthalocyanine based photoreceptor having high sensitivity to near infrared light, it is believed of value to control not only the purity and chemical structure of the pigment, as is generally the situation with organic photoconductors, but also to prepare the pigment in a certain crystal modification. Consequently, it is still desirable to provide a photoconductor where the titanyl phthalocyanine is generated by a process that will provide high sensitivity titanyl phthalocyanines.

In embodiments, the Type V phthalocyanine pigment included in the photogenerating layer can be generated by dissolving Type I titanyl phthalocyanine in a solution comprising a trihaloacetic acid and an alkylene halide; adding the resulting mixture comprising the dissolved Type I titanyl phthalocyanine to a solution comprising an alcohol and an alkylene halide thereby precipitating a Type Y titanyl phthalocyanine; and treating the resulting Type Y titanyl phthalocyanine with monochlorobenzene.

With further respect to the titanyl phthalocyanines selected for the photogenerating layer, such phthalocyanines exhibit a crystal phase that is distinguishable from other known titanyl phthalocyanine polymorphs, and are designated as Type V polymorphs prepared by converting a Type I titanyl phthalocyanine to a Type V titanyl phthalocyanine pigment. The processes include converting a Type I titanyl phthalocyanine to an intermediate titanyl phthalocyanine, which is designated as a Type Y titanyl phthalocyanine, and then subsequently converting the Type Y titanyl phthalocyanine to a Type V titanyl phthalocyanine.

In one embodiment, the process comprises (a) dissolving a Type I titanyl phthalocyanine in a suitable solvent; (b) adding the solvent solution comprising the dissolved Type I titanyl phthalocyanine to a quenching solvent system to precipitate an intermediate titanyl phthalocyanine (designated as a Type Y titanyl phthalocyanine); and (c) treating the resultant Type Y phthalocyanine with a halo, such as, for example, monochlorobenzene to obtain a resultant high sensitivity titanyl phthalocyanine, which is designated herein as a Type V titanyl phthalocyanine. In another embodiment, prior to treating the Type Y phthalocyanine with a halo, such as monochlorobenzene, the Type Y titanyl phthalocyanine may be washed with various solvents including, for example, water, and/or methanol. The quenching solvents system to which the solution comprising the dissolved Type I titanyl phthalocyanine is added comprises, for example, an alkyl alcohol and an alkylene halide.

The process illustrated herein further provides a titanyl phthalocyanine having a crystal phase distinguishable from other known titanyl phthalocyanines. The titanyl phthalocyanine Type V prepared by a process according to the present disclosure is distinguishable from, for example, Type IV titanyl phthalocyanines in that a Type V titanyl phthalocyanine exhibits an X-ray powder diffraction spectrum having four characteristic peaks at 9.0°, 9.6°, 24.0°, and 27.2°, while Type IV titanyl phthalocyanines typically exhibit only three characteristic peaks at 9.6°, 24.0°, and 27.2°.

In a process embodiment for preparing a high sensitivity phthalocyanine in accordance with the present disclosure, a Type I titanyl phthalocyanine is dissolved in a suitable solvent. In embodiments, a Type I titanyl phthalocyanine is dissolved in a solvent comprising a trihaloacetic acid and an alkylene halide. The alkylene halide comprises, in embodiments, from about one to about six carbon atoms. An example of a suitable trihaloacetic acid includes, but is not limited to, trifluoroacetic acid. In one embodiment, the solvent for dissolving a Type I titanyl phthalocyanine comprises trifluoroacetic acid and methylene chloride. In embodiments, the trihaloacetic acid is present in an amount of from about one volume part to about 100 volume parts of the solvent, and the alkylene halide is present in an amount of from about one volume part to about 100 volume parts of the solvent. In one embodiment, the solvent comprises methylene chloride and trifluoroacetic acid in a volume-to-volume ratio of about 4 to 1. The Type I titanyl phthalocyanine is dissolved in the solvent by stirring for an effective period of time, such as, for example, for about 30 seconds to about 24 hours, at room temperature. The Type I titanyl phthalocyanine is dissolved by, for example, stirring in the solvent for about one hour at room temperature (about 25° C.). The Type I titanyl phthalocyanine may be dissolved in the solvent in either air or in an inert atmosphere (argon or nitrogen).

Sensitivity is a valuable electrical characteristic of electrophotographic imaging members or photoreceptors. Sensitivity may be described in two aspects. The first aspect of sensitivity is spectral sensitivity, which refers to sensitivity as a function of wavelength. An increase in spectral sensitivity implies an appearance of sensitivity at a wavelength in which previously no or little sensitivity was detected. The second aspect of sensitivity, broadband sensitivity, is a change of sensitivity, for example an increase at a particular wavelength previously exhibiting sensitivity, or a general increase of sensitivity encompassing all wavelengths previously exhibiting sensitivity. This second aspect of sensitivity may also be considered as change of sensitivity, encompassing all wavelengths, with a broadband (white) light exposure. A problem encountered in the manufacturing of photoreceptors is maintaining consistent spectral and broadband sensitivity from batch to batch.

In embodiments, examples of polymeric binder materials that can be selected as the matrix for the photogenerating layer are thermoplastic and thermosetting resins, such as polycarbonates, polyesters, polyamides, polyurethanes, polystyrenes, polyarylsilanols, polyarylsulfones, polybutadienes, polysulfones, polysilanolsulfones, polyethylenes, polypropylenes, polyimides, polymethylpentenes, poly(phenylene sulfides), poly(vinyl acetate), polysiloxanes, polyacrylates, polyvinyl acetals, polyamides, polyimides, amino resins, phenylene oxide resins, terephthalic acid resins, phenoxy resins, epoxy resins, phenolic resins, polystyrene and acrylonitrile copolymers, poly(vinyl chloride), vinyl chloride and vinyl acetate copolymers, acrylate copolymers, alkyd resins, cellulosic film formers, poly(amideimide), styrene butadiene copolymers, vinylidene chloride-vinyl chloride copolymers, vinyl acetate-vinylidene chloride copolymers, styrene-alkyd resins, poly(vinyl carbazole), and the like. These polymers may be block, random, or alternating copolymers.

The photogenerating composition or pigment is present in the resinous binder composition in various amounts. Generally, however, from about 5 percent by weight to about 90 percent by weight of the photogenerating pigment is dispersed in about 10 percent by weight to about 95 percent by weight of the resinous binder, or from about 20 percent by weight to about 50 percent by weight of the photogenerating pigment is dispersed in about 80 percent by weight to about 50 percent by weight of the resinous binder composition. In one embodiment, about 50 percent by weight of the photogenerating pigment is dispersed in about 50 percent by weight of the resinous binder composition. The total weight percent of components in the photogenerating layer is about 100.

Various suitable and conventional known processes may be used to mix, and thereafter apply the photogenerating layer coating mixture like spraying, dip coating, roll coating, wire wound rod coating, vacuum sublimation, and the like. For some applications, the photogenerating layer may be fabricated in a dot or line pattern. Removal of the solvent of a solvent-coated photogenerating layer may be effected by any known conventional techniques such as oven drying, infrared radiation drying, air drying, and the like.

The coating of the photogenerating layer, in embodiments of the present disclosure, can be accomplished to achieve a final dry thickness of the photogenerating layer as illustrated herein, and for example, from about 0.01 to about 30 microns after being dried at, for example, about 40° C. to about 150° C. for about 1 to about 90 minutes. More specifically, a photogenerating layer of a thickness, for example, of from about 0.1 to about 30 microns, or from about 0.5 to about 2 microns can be applied to or deposited on the substrate, on other surfaces in between the substrate and the charge transport layer, and the like. A charge blocking layer or hole blocking layer may optionally be applied to the electrically conductive surface prior to the application of a photogenerating layer. When desired, an adhesive layer may be included between the hole blocking layer, or interfacial layer, and the photogenerating layer. Usually, the photogenerating layer is applied onto the hole blocking layer, and a charge transport layer or plurality of charge transport layers are formed on the photogenerating layer. The photogenerating layer may be applied on top of or below the charge transport layer.

In embodiments, a suitable known adhesive layer can be included in the photoconductor. Typical adhesive layer materials include, for example, polyesters, polyurethanes, and the like. The adhesive layer thickness can vary and, in embodiments, is, for example, from about 0.05 micron (500 Angstroms) to about 0.3 micron (3,000 Angstroms). The adhesive layer can be deposited on the hole blocking layer by spraying, dip coating, roll coating, wire wound rod coating, gravure coating, Bird applicator coating, and the like. Drying of the deposited coating may be effected by, for example, oven drying, infrared radiation drying, air drying, and the like.

As an optional adhesive layer or layers usually in contact with or situated between the hole blocking layer and the photogenerating layer, there can be selected various known substances inclusive of copolyesters, polyamides, poly(vinyl butyral), poly(vinyl alcohol), polyurethane, and polyacrylonitrile. This layer is, for example, of a thickness of from about 0.001 to about 1 micron, or from about 0.1 to about 0.5 micron. Optionally, this layer may contain effective suitable amounts, for example from about 1 to about 10 weight percent, of conductive and nonconductive particles, such as zinc oxide, titanium dioxide, silicon nitride, carbon black, and the like, to provide, for example, in embodiments of the present disclosure, further desirable electrical and optical properties.

The hole blocking or undercoat layer or layers for the photoconductors of the present disclosure can contain a number of components including known hole blocking components, such as amino silanes, doped metal oxides, a metal oxide like titanium, chromium, zinc, tin, and the like; a mixture of phenolic compounds and a phenolic resin, or a mixture of two phenolic resins, and optionally a dopant such as $SiO_2$. The phenolic compounds usually contain at least two phenol groups, such as bisphenol A (4,4'-isopropylidenediphenol), E (4,4'-ethylidenebisphenol), F (bis(4-hydroxyphenyl)methane), M (4,4'-(1,3-phenylenediisopropylidene)bisphenol), P (4,4'-(1,4-phenylene diisopropylidene)bisphenol), S (4,4'-sulfonyldiphenol), and Z (4,4'-cyclohexylidenebisphenol); hexafluorobisphenol A (4,4'-(hexafluoro isopropylidene) diphenol), resorcinol, hydroxyquinone, catechin, and the like.

The hole blocking layer can be, for example, comprised of from about 20 weight percent to about 80 weight percent, and more specifically, from about 55 weight percent to about 65 weight percent of a suitable component like a metal oxide, such as $TiO_2$; from about 20 weight percent to about 70 weight percent, and more specifically, from about 25 weight percent to about 50 weight percent of a phenolic resin; from about 2 weight percent to about 20 weight percent, and more specifically, from about 5 weight percent to about 15 weight percent of a phenolic compound containing, for example, at least two phenolic groups, such as bisphenol S; and from about 2 weight percent to about 15 weight percent, and more specifically, from about 4 weight percent to about 10 weight percent of a plywood suppression dopant, such as $SiO_2$. The hole blocking layer coating dispersion can, for example, be prepared as follows. The metal oxide/phenolic resin dispersion is first prepared by ball milling or dynomilling until the median particle size of the metal oxide in the dispersion is less than about 10 nanometers, for example from about 5 to about 9 nanometers. To the above dispersion are added a phenolic compound and dopant followed by mixing. The hole blocking layer coating dispersion can be applied by dip coating or web coating, and the layer can be thermally cured after coating. The hole blocking layer resulting is, for example, of a thickness of from about 0.01 to about 30 microns, and more specifically, from about 0.1 to about 8 microns. Examples of phenolic resins include formaldehyde polymers with phenol, p-tert-butylphenol, cresol, such as VARCUM® 29159 and 29101 (available from OxyChem Company), and DURITE® 97 (available from Borden Chemical); formaldehyde polymers with ammonia, cresol and phenol, such as VARCUM® 29112 (available from OxyChem Company); formaldehyde polymers with 4,4'-(1-methylethylidene)bisphenol, such as VARCUM® 29108 and 29116 (available from OxyChem Company); formaldehyde polymers with cresol and phenol, such as VARCUM® 29457 (available from OxyChem Company), DURITE® SD-423A, SD-422A (available from Borden Chemical); or formaldehyde polymers with phenol and p-tert-butylphenol, such as DURITE® ESD 556C (available from Borden Chemical).

Charge transport layer components and molecules include a number of known materials, such as those illustrated herein, such as aryl amines, which layer is generally of a thickness of from about 5 to about 75 microns, and more specifically, of a thickness of from about 10 to about 40 microns. Examples of charge transport layer components include

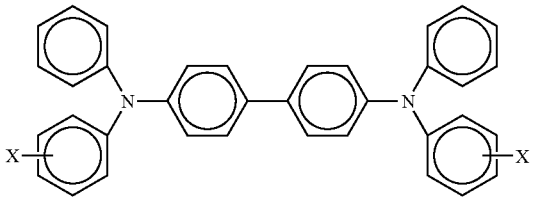

and

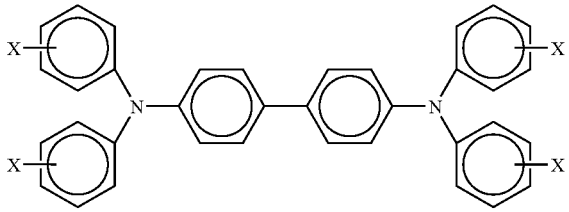

wherein X is alkyl, alkoxy, aryl, a halogen, or mixtures thereof, and especially those substituents selected from the group consisting of Cl, $OCH_3$ and $CH_3$; and molecules of the following formula

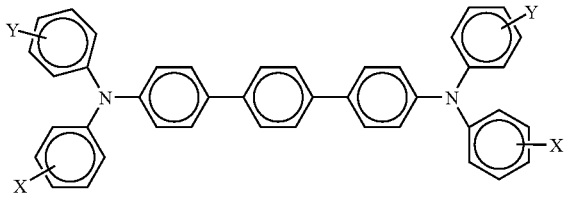

wherein X and Y are independently alkyl, alkoxy, aryl, a halogen, or mixtures thereof.

Alkyl and alkoxy contain, for example, from 1 to about 25 carbon atoms, and more specifically, from 1 to about 12 carbon atoms, such as methyl, ethyl, propyl, butyl, pentyl, and the corresponding alkoxides. Aryl can contain from 6 to about 36 carbon atoms, such as phenyl, and the like. Halogen includes chloride, bromide, iodide, and fluoride. Substituted alkyls, alkoxys, and aryls can also be selected in embodiments.

Examples of specific charge transport compounds include N,N'-diphenyl-N,N'-bis (alkylphenyl)-1,1-biphenyl-4,4'-diamine wherein alkyl is selected from the group consisting of methyl, ethyl, propyl, butyl, hexyl, and the like; N,N'-diphenyl-N,N'-bis(halophenyl)-1,1'-biphenyl-4,4'-diamine wherein the halo substituent is a chloro substituent; N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4-diamine, N,N'-bis(4-butylphenyl)-N,N'-bis-(2-ethyl-6-methylphenyl[p-terphenyl]-4,4'-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4'-diamine, tetra-p-tolyl-biphenyl-4,4'-diamine, N,N'-diphenyl-N,N'-bis(4-methoxyphenyl)-1,1-biphenyl-4,4'-diamine, and the like. Other known charge transport layer molecules can be selected, reference for example, U.S. Pat. Nos. 4,921,773 and 4,464,450, the disclosures of which are totally incorporated herein by reference.

In embodiments, the charge transport component can be represented by the following formulas/structures

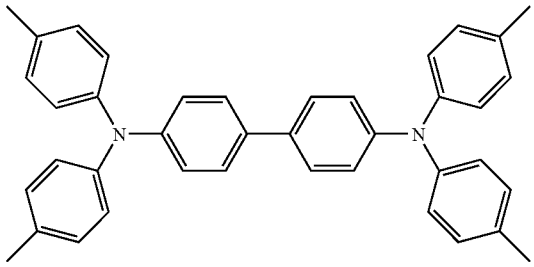

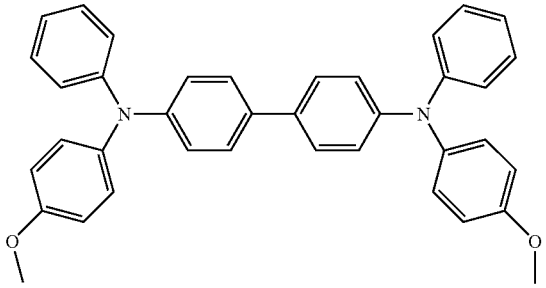

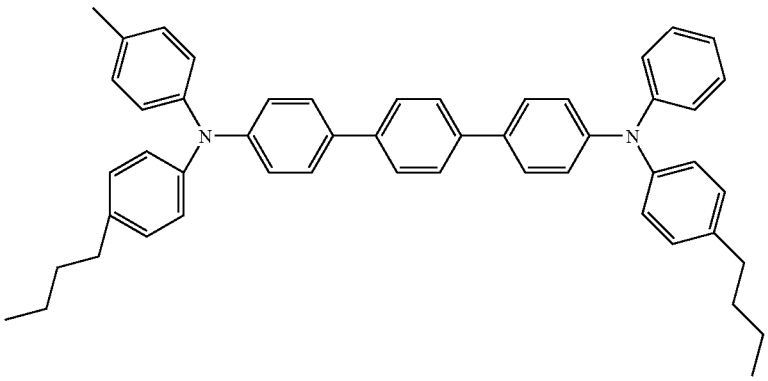

-continued

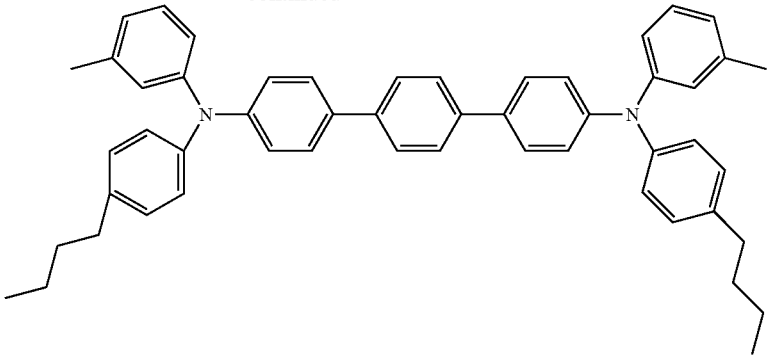

and

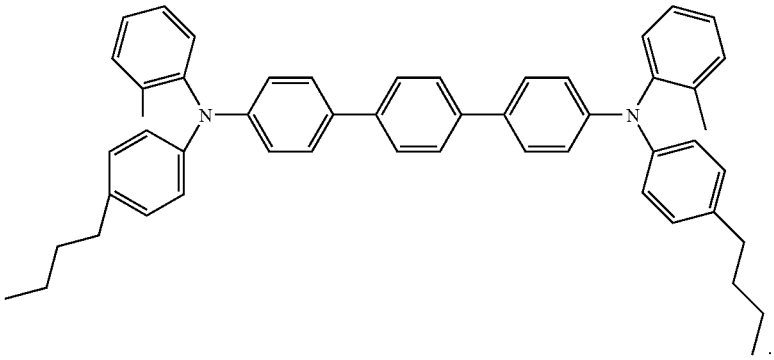

Examples of the binder materials selected for the charge transport layers include polycarbonates, polyarylates, acrylate polymers, vinyl polymers, cellulose polymers, polyesters, polysiloxanes, polyamides, polyurethanes, poly(cyclo olefins), epoxies, and random or alternating copolymers thereof; and more specifically, polycarbonates such as poly (4,4'-isopropylidene-diphenylene)carbonate (also referred to as bisphenol-A-polycarbonate), poly(4,4'-cyclohexylidine diphenylene)carbonate (also referred to as bisphenol-Z-polycarbonate), poly(4,4'-isopropylidene-3,3'-dimethyl-diphenyl)carbonate (also referred to as bisphenol-C-polycarbonate), and the like. In embodiments, the charge transport layer binders are comprised of polycarbonate resins with a weight average molecular weight of from about 20,000 to about 100,000, or with a molecular weight $M_w$ of from about 50,000 to about 100,000 preferred. Generally, in embodiments the transport layer contains from about 10 to about 75 percent by weight of the charge transport material, and more specifically, from about 35 percent to about 50 percent of this material.

The charge transport layer or layers, and more specifically, a first charge transport in contact with the photogenerating layer, and thereover a top or second charge transport overcoating layer may comprise charge transporting small molecules dissolved or molecularly dispersed in a film forming electrically inert polymer such as a polycarbonate. In embodiments, "dissolved" refers, for example, to forming a solution in which the small molecule and silanol are dissolved in the polymer to form a homogeneous phase; and "molecularly dispersed in embodiments" refers, for example, to charge transporting molecules dispersed in the polymer, the small molecules being dispersed in the polymer on a molecular scale. Various charge transporting or electrically active small molecules may be selected for the charge transport layer or layers. In embodiments, charge transport refers, for example, to charge transporting molecules as a monomer that allows the free charge generated in the photogenerating layer to be transported across the transport layer.

Examples of hole transporting molecules, especially for the first and second charge transport layers, include, for example, pyrazolines such as 1-phenyl-3-(4'-diethylamino styryl)-5-(4"-diethylamino phenyl)pyrazoline; aryl amines such as N,N'-diphenyl-N,N'-bis(3-methylphenyl)-(1,1'-biphenyl)-4,4'-diamine, tetra-p-tolyl-biphenyl-4,4'-diamine, N,N'-diphenyl-N,N'-bis(4-methoxyphenyl)-N,N'-bis(4-butylphenyl)-N,N'-di-p-tolyl-[p-terphenyl]-4,4'-diamine, N,N'-bis(4-butylphenyl)-N,N'-di-m-toyl-[-p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, N,N'-diphenyl-N,N'-bis(3-chlorophenyl)-[p-terphenyl]-4,4'-diamine; hydrazones such as N-phenyl-N-methyl-3-(9-ethyl) carbazyl hydrazone, and 4-diethyl amino benzaldehyde-1,2-diphenyl hydrazone; and oxadiazoles, such as 2,5-bis(4-N,N'-diethylaminophenyl)-1,2,4-oxadiazole, stilbenes, and the like. However, in embodiments, to minimize or avoid cycle-up in equipment, such as printers, with high throughput, the charge transport layer should be substantially free (less than about two percent) of di or triamino-triphenyl methane. A small molecule charge transporting compound that permits injection of holes into the photogenerating layer with high efficiency, and transports them across the charge transport layer with short transit times, and which layer contains a binder and a silanol includes N,N'-diphenyl-N,N'-bis(3-methylphenyl)-(1,1'-biphenyl)-4,4'-diamine, tetra-p-tolyl-biphenyl-4,4'-diamine, N,N'-diphenyl-N,N'-bis(4-methoxyphenyl)-1,1-biphenyl-4,4'-diamine, N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-tolyl-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, and N,N'-diphenyl-N,N'-bis(3-chlorophenyl)-[p-terphenyl]-4,4'-diamine, or mixtures thereof. If desired, the charge transport material in the charge transport layer may comprise a polymeric charge transport material, or a combination of a small molecule charge transport material, and a polymeric charge transport material.

The thickness of each of the charge transport layers in embodiments is from about 5 to about 75 microns, but thicknesses outside this range may, in embodiments, also be selected. The charge transport layer should be an insulator to the extent that an electrostatic charge placed on the hole transport layer is not conducted in the absence of illumination at a rate sufficient to prevent formation and retention of an electrostatic latent image thereon. In general, the ratio of the thickness of the charge transport layer to the photogenerating layer can be from about 2:1 to 200:1, and in some instances 400:1. The charge transport layer is substantially nonabsorbing to visible light or radiation in the region of intended use, but is electrically "active" in that it allows the injection of photogenerated holes from the photoconductive layer, or photogenerating layer, and allows these holes to be transported to thereby selectively discharge a surface charge on the surface of the active layer.

The thickness of the continuous charge transport overcoat layer selected depends upon the abrasiveness of the charging (bias charging roll), cleaning (blade or web), development (brush), transfer (bias transfer roll), and the like in the system employed, and can be up to about 10 microns. In embodiments, this thickness for each layer is from about 1 to about 5 microns. Various suitable and conventional methods may be used to mix, and thereafter apply the overcoat layer coating mixture to the photoconductor. Typical application techniques include spraying, dip coating, roll coating, wire wound rod coating, and the like. Drying of the deposited coating may be effected by any suitable conventional technique, such as oven drying, infrared radiation drying, air drying, and the like. The dried overcoating layer of this disclosure should transport holes during imaging, and should not have too high a free carrier concentration.

The overcoat can comprise the same components as the charge transport layer wherein the weight ratio between the charge transporting small molecules, and the suitable electrically inactive resin binder is, for example, from about 0/100 to about 60/40, or from about 20/80 to about 40/60.

Examples of components or materials optionally incorporated into the charge transport layers, or at least one charge transport layer to, for example, enable improved lateral charge migration (LCM) resistance include hindered phenolic antioxidants, such as tetrakis methylene(3,5-di-tert-butyl-4-hydroxy hydrocinnamate) methane (IRGANOX® 1010, available from Ciba Specialty Chemical), butylated hydroxytoluene (BHT), and other hindered phenolic antioxidants including SUMILIZER™ BHT-R, MDP-S, BBM-S, WX-R, NW, BP-76, BP-101, GA-80, GM and GS (available from Sumitomo Chemical Company, Ltd.), IRGANOX® 1035, 1076, 1098, 1135, 1141, 1222, 1330, 1425WL, 1520L, 245, 259, 3114, 3790, 5057 and 565 (available from Ciba Specialties Chemicals), and ADEKA STAB™ AO-20, AO-30, AO-40, AO-50, AO-60, AO-70, AO-80 and AO-330 (available from Asahi Denka Company, Ltd.); hindered amine antioxidants such as SANOL™ LS-2626, LS-765, LS-770 and LS-744 (available from SNKYO CO., Ltd.), TINUVIN® 144 and 622LD (available from Ciba Specialties Chemicals), MARK™ LA57, LA67, LA62, LA68 and LA63 (available from Asahi Denka Co., Ltd.), and SUMILIZER™ PS (available from Sumitomo Chemical Co., Ltd.); thioether antioxidants such as SUMILIZER™ TP-D (available from Sumitomo Chemical Co., Ltd); phosphite antioxidants such as MARK™ 2112, PEP-8, PEP-24G, PEP-36, 329K and HP-10 (available from Asahi Denka Co., Ltd.); other molecules, such as bis(4-diethylamino-2-methylphenyl) phenylmethane (BDETPM), bis-[2-methyl-4-(N-2-hydroxyethyl-N-ethyl-aminophenyl)]-phenylmethane (DHTPM), and the like. The weight percent of the antioxidant in at least one of the charge transport layers is from about 0 to about 20, from about 1 to about 10, or from about 3 to about 8 weight percent.

Primarily for purposes of brevity, the examples of each of the substituents, and each of the components/compounds/molecules, polymers, (components) for each of the layers, specifically disclosed herein are not intended to be exhaustive. Thus, a number of components, polymers, formulas, structures, and R group or substituent examples, and carbon chain lengths not specifically disclosed or claimed are intended to be encompassed by the present disclosure and claims. Also, the carbon chain lengths are intended to include all numbers between those disclosed or claimed or envisioned, thus from 1 to about 20 carbon atoms, and from 6 to about 36 carbon atoms includes 1, 2, 3, 4, 5, 6, 7, 8, 9, 10, 11, 12, 13, 14, 15, up to 36, or more. At least one refers, for example, to from 1 to about 5, from 1 to about 2, 1, 2, and the like. Similarly, the thickness of each of the layers, the examples of components in each of the layers, the amount ranges of each of the components disclosed and claimed is not exhaustive, and it is intended that the present disclosure and claims encompass other suitable parameters not disclosed or that may be envisioned.

The following Examples are being submitted to illustrate embodiments of the present disclosure. Also, parts and percentages are by weight unless otherwise indicated. All photoconductor devices are prepared on 30 millimeter drum substrates.

Comparative Example 1

(A) A photoconductor was prepared by providing a 0.02 micron thick titanium layer coated (coater device used) on a biaxially oriented polyethylene naphthalate substrate (KALEDEX™ 2000) having a thickness of 3.5 mils, and applying thereon, with a gravure applicator or an extrusion coater, a solution containing 50 grams of 3-amino-propyltriethoxysilane, 41.2 grams of water, 15 grams of acetic acid, 684.8 grams of denatured alcohol, and 200 grams of heptane. This layer was then dried for about 5 minutes at 135° C. in the forced air dryer of the coater. The resulting charge blocking layer had a dry thickness of 500 Angstroms. An adhesive layer was then prepared by applying a wet coating over the blocking layer using a gravure applicator or an extrusion coater, and which adhesive layer contained 0.2 percent by weight based on the total weight of the solution of the copolyester adhesive (ARDEL™ D100 available from Toyota Hsutsu Inc.) in a 60:30:10 volume ratio mixture of tetrahydrofuran/monochlorobenzene/methylene chloride. The adhesive layer was then dried for about 5 minutes at 135° C. in the forced air dryer of the coater. The resulting adhesive layer had a dry thickness of 200 Angstroms.

A photogenerating layer dispersion was prepared by introducing 0.45 gram of the known polycarbonate IUPILON™ 200 (PCZ-200) or POLYCARBONATE Z™, weight average molecular weight of 20,000, available from Mitsubishi Gas Chemical Corporation, and 50 milliliters of tetrahydrofuran into a 4 ounce glass bottle. To this solution were added 2.4 grams of hydroxygallium phthalocyanine (Type V), and 300 grams of ⅛ inch (3.2 millimeters) diameter stainless steel shot. The resulting mixture was then placed on a ball mill for 8 hours. Subsequently, 2.25 grams of PCZ-200 were dissolved in 46.1 grams of tetrahydrofuran, and added to the hydroxygallium phthalocyanine dispersion. The obtained slurry was then placed on a shaker for 10 minutes. The resulting dispersion was, thereafter, applied to the above adhesive interface with a Bird applicator to form a photogenerating layer having a wet thickness of 0.25 mil. The photogenerating layer was dried at 120° C. for 1 minute in a forced air oven to form a dry photogenerating layer having a thickness of 0.4 micron.

The resulting imaging member web was then overcoated with two charge transport layers. Specifically, the photogenerating layer was overcoated with a charge transport layer (the bottom or first pass charge transport layer) in contact with the photogenerating layer. The bottom layer of the charge transport layer was prepared by introducing into an amber glass bottle in a weight ratio of 1:1 N,N'-diphenyl-N,N'-bis(3-methylphenyl)-1,1'-biphenyl-4,4'-diamine (mTBD), and MAKROLON® 5705, a known polycarbonate resin having a molecular weight average of from about 50,000 to about 100,000, commercially available from Farbenfabriken Bayer A.G. The resulting mixture was then dissolved in methylene chloride to form a solution containing 15 percent by weight solids. This solution was applied on the photogenerating layer to form the bottom layer coating that upon drying (120° C. for 1 minute) had a thickness of 14.5 microns. During this coating process, the humidity was equal to or less than 15 percent.

The bottom layer of the charge transport layer was then overcoated with a top or second pass layer. The charge transport layer solution of the top layer was prepared by introducing into an amber glass bottle in a weight ratio of 0.35:0.65 N,N'-diphenyl-N,N'-bis(3-methylphenyl)-1,1'-biphenyl-4,4'-diamine, and MAKROLON® 5705, a known polycarbonate resin having a molecular weight average of from about 50,000 to about 100,000, commercially available from Farbenfabriken Bayer A.G. The resulting mixture was then dissolved in methylene chloride to form a solution containing 15 percent by weight solids. The top layer solution was applied on the bottom layer of the charge transport layer to form a coating that upon drying (120° C. for 1 minute) had a thickness of 14.5 microns. During this coating process, the humidity was equal to about 15 percent.

(B) A photoconductor was prepared by repeating the above part (A), except that there was excluded the top second pass charge transport layer and the thickness of the bottom charge transport layer was 29 microns.

Example I

A photoconductive member was prepared by repeating the process of Comparative Example 1(A) except that there was included in the first pass charge transport layer 0.2 weight percent of the thiobis(thioformate), O,O-diisopropyl dithiobis(thioformate) (also referred to as isopropylxanthic disulfide), available from TCI America, and where the first pass charge transport layer coating solution was comprised of MAKROLON® 5705/mTBDamine/thiobis(thioformate) in a ratio of 49.9/49.9/0.2 in $CH_2Cl_2$ at about 15 weight percent solids.

Example II

A photoconductive member was prepared by repeating the process of Comparative Example 1(A) except that there was present in the first pass charge transport layer 0.4 weight percent of the thiobis(thioformate), O,O-diisopropyl dithiobis(thioformate), available from TCI America, and where the final first pass charge transport layer coating solution was comprised of MAKROLON® 5705/mTBD/thiobis(thioformate) in a ratio of 49.8/49.8/0.4 in $CH_2Cl_2$ at about 15 weight percent solids.

Example III

A photoconductive member was prepared by repeating the process of Comparative Example 1(A) except that there was present in the photogenerating layer 5 weight percent of the thiobis(thioformate), O,O-diisopropyl dithiobis(thioformate) available from TCI America, and where the ratio amount of hydroxygallium Type V photogenerating pigment/polycarbonate (PC2-200)binder/thiobis(thioformate) was 44.8/50.2/5.

Example IV

A number of photoconductors are prepared by repeating the process of Example II except that there is included in the first pass charge transport layer 0.4 weight percent of at least one of O,O-di(1-methylethyl)trithiobis(thioformate), O,O-di(1-methylethyl)tetrathiobis(thioformate), O,O-di(1-methylethyl)pentathiobis (thioformate), O,O-diethyl dithiobis(thioformate), O,O-dimethyl dithiobis(thioformate), diisopropyl xanthogen polysulfide, and dibutyl xanthogen disulfide.

Example V

A number of photoconductors are prepared by repeating the process of Example III except that there is included in the photogenerating layer 5 weight percent of at least one of O,O-di(1-methylethyl)trithiobis(thioformate), O,O-di(1-methylethyl)tetrathiobis(thioformate), O,O-di(1-methylethyl)pentathiobis(thioformate), O,O-diethyl dithiobis(thioformate), O,O-dimethyl dithiobis(thioformate), diisopropyl xanthogen polysulfide, and dibutyl xanthogen disulfide.

Electrical Property Testing

A number of the above prepared photoconductors (Comparative Example 1(A) and Examples I, II and III) were tested in a scanner set to obtain photoinduced discharge cycles, sequenced at one charge-erase cycle followed by one charge-expose-erase cycle, wherein the light intensity was incrementally increased with cycling to produce a series of photoinduced discharge characteristic curves (PIDC) from which the photosensitivity and surface potentials at various exposure intensities were measured. Additional electrical characteristics were obtained by a series of charge-erase cycles with incrementing surface potential to generate several voltage versus charge density curves. The scanner was equipped with a scorotron set to a constant voltage charging at various surface potentials. The photoconductors were tested at surface potentials of 400 volts with the exposure light intensity incrementally increased by means of regulating a series of neutral density filters; the exposure light source was a 780 nanometer light emitting diode. The above xerographic simulation was completed in an environmentally controlled light tight chamber at ambient conditions (40 percent relative humidity and 22° C.).

Substantially identical PIDC characteristics were observed for the above photoconductors. Incorporation of the thiobis (thioformate) into either the charge transport layer or the photogenerating layer had no substantial negative impacts on PIDC.

Ghosting Measurement

When a photoconductor is selectively exposed to positive charges in a number of known xerographic test print engines, it has been observed that some of these charges enter the photoconductor, and manifest themselves as a latent image in the next printing cycle. These print defects can cause a change in the lightness of the half tones, and is commonly referred to as a "ghost" that is generated in the previous printing cycle.

An example of a source of the positive charges is the stream of positive ions emitted from the transfer corotron. Since the paper sheets are situated between the transfer corotron and the photoconductor, the photoconductor is shielded from the positive ions from the paper sheets. In the areas between the paper sheets, the photoconductor is fully exposed, thus in this paper free zone the positive charges may enter the photoconductor. As a result, these charges cause a print defect or ghost in a half tone print when one switches, for example, to a larger paper format that covers the previous paper print free zone.

In the ghosting test, a number of the above prepared photoconductors were electrically cycled to simulate continuous xerographic printing. At the end of every tenth cycle known, incremental positive charges were injected into the photoconductors tested. In the follow-on cycles, the electrical response to these injected charges were measured and then translated into a rating scale.

The electrical response to the injected charges in the print engine, and in the electrical test fixture (a lab surrogate tool) evidenced a drop in the surface potential. This drop was calibrated to colorimetric values in the prints, and they in turn were calibrated to a ranking scale of an average visual rating by at least two observers. On this scale, 1 refers to no observable ghost, and values of 7 or above refer to a very strong unacceptable ghost. The functional dependence between the change in surface potential and the ghosting scale is slightly supra-linear, and may, in first approximation, be linearly scaled.

For the ghosting test, there were deposited ⅜ inch diameter, 150 Å thick, gold dots, using a sputterer, onto the transport layer of the photoconductors of Comparative Example 1(A) and Examples I, II and III. These photoconductors were then dark rested (in the absence of light) for at least two days at 22° C. and 50 percent RH to allow relaxation of the surfaces.

The above electroded photoconductor devices (gold dot on charge transport layer surface) were then cycled in a known test fixture that injected positive charge through the gold dots with the methodology described above. The change in surface potential was then determined for the injected charges of 27 $nC/cm^2$ (nC is nano Coulomb, the unit for charge). This value unit for charge was selected to be a little larger than typically expected in a Xerox Corporation iGEN3® test print engine to generate strong signals. Finally, the changes in the surface potentials were translated into ghost rankings by the above observations and calibration curves. This method was repeated 4 times for each photoconductor, and then the averages were calculated. Typical standard deviation of the mean tested on numerous devices was about 0.35. The ghost ratings are reported in Table 1 with the Example photoconductors evidencing less ghosting as compared to the photoconductor of Comparative Example 1(A).

TABLE 1

| | Ghost Rating |
|---|---|
| Comparative Example 1 (A) | 8.4 |
| Example I | 6.9 |
| Example II | 4.2 |
| Example III | 4.6 |

Incorporation of the thiobis(thioformate) into either the charge transport layer or the photogenerating layer improved and reduced the ghosting characteristics for the Examples I, II and III photoconductors as compared to the photoconductor of Comparative Example 1(A), with the Example II photoconductor ghosting being an excellent, about 50 percent less than the 8.4 for Comparative Example 1(A) photoconductors as demonstrated by the data in Table 1.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A photoconductor comprising an optional supporting substrate, a photogenerating layer, and at least one charge transport layer containing a charge transport component, and wherein at least one of said photogenerating layers and at least one of said charge transport layers includes a thiobis (thioformate).

2. A photoconductor in accordance with claim 1 wherein said charge transport layer is comprised of said charge transport component, a polymeric binder, and said thiobis(thioformate).

3. A photoconductor in accordance with claim 1 wherein said at least one charge transport layer is two.

4. A photoconductor in accordance with claim 1 wherein said thiobis(thioformate) is represented by

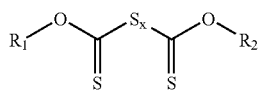

wherein each R is independently at least one of alkyl, alkoxy, aryl, and a polysaccharide, and x is a number of from about 1 to about 10.

5. A photoconductor in accordance with claim 4 wherein said alkyl and said alkoxy contain from 1 to about 25 carbon atoms, and said aryl contains from 6 to about 42 carbon atoms.

6. A photoconductor in accordance with claim 4 wherein said alkyl and said alkoxy contain from 1 to about 6 carbon atoms, and said aryl contains from 6 to about 18 carbon atoms, and wherein x is a number of from about 2 to about 8.

7. A photoconductor in accordance with claim 1 wherein said thiobis(thioformate) is

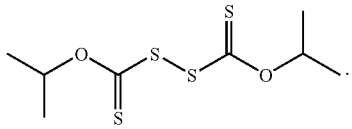

8. A photoconductor in accordance with claim 1 wherein said thiobis(thioformate) is selected from the group consisting of at least one of O,O-diisopropyl dithiobis(thioformate), O,O-di(1-methylethyl)trithiobis(thioformate), O,O-di(1-methylethyl)tetrathiobis(thioformate), O,O-di(1-methylethyl) pentathiobis(thioformate), O,O-diethyl dithiobis(thioformate), O,O-dimethyl dithiobis(thioformate), and starch dithiobis(thioformate).

9. A photoconductor in accordance with claim 1 wherein said thiobis(thioformate) is contained in said photogenerating layer.

10. A photoconductor in accordance with claim 1 wherein said thiobis(thioformate) is contained in at least one of said charge transport layers, and wherein at least one charge transport layer is 1, 2, or 3 layers.

11. A photoconductor in accordance with claim 1 wherein said thiobis(thioformate) is contained in both said photogenerating layer and at least one of said charge transport layers, and wherein at least one charge transport layer is 1, 2, or 3 layers.

12. A photoconductor in accordance with claim 1 wherein said thiobis(thioformate) is present in an amount of from about 0.01 to about 30 weight percent.

13. A photoconductor in accordance with claim 1 wherein said thiobis(thioformate) is present in an amount of from about 0.1 to about 20 weight percent.

14. A photoconductor in accordance with claim 1 wherein said thiobis(thioformate) is present in an amount of from about 0.2 to about 10 weight percent.

15. A photoconductor in accordance with claim 1 wherein said thiobis(thioformate) is present in an amount of from about 0.1 to about 12 weight percent, and wherein the thickness of said charge transport layer is from about 10 to about 50 microns, and wherein at least one charge transport layer is 1, 2, or 3 layers.

16. A photoconductor in accordance with claim 1 wherein said thiobis(thioformate) is present in an amount of from about 0.1 to about 2 weight percent in the charge transport layer, and from about 1 to about 10 weight percent in the photogenerating layer, and wherein at least one charge transport layer is 1 or 2 layers.

17. A photoconductor in accordance with claim 1 wherein said charge transport component is represented by at least one of

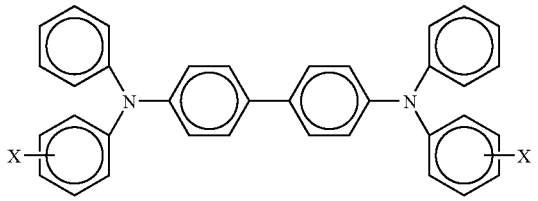

and

-continued

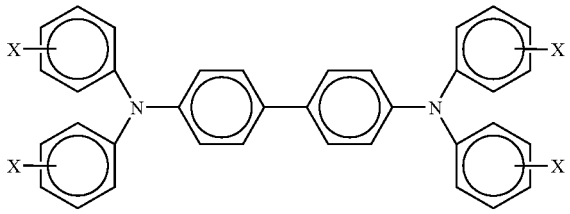

wherein X is selected from the group consisting of alkyl, alkoxy, aryl, and halogen, and mixtures thereof.

18. A photoconductor in accordance with claim 1 wherein said charge transport component is represented by

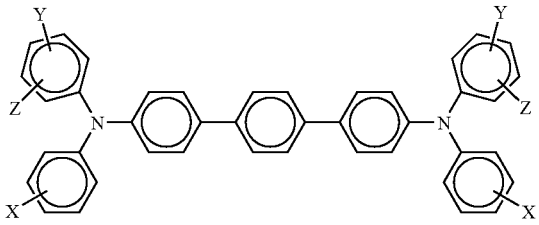

wherein X, Y, and Z are independently selected from the group consisting of alkyl, alkoxy, aryl, and halogen, and mixtures thereof.

19. A photoconductor in accordance with claim 1 wherein said charge transport component is selected from at least one of the group consisting of N,N'-diphenyl-N,N-bis(3-methylphenyl)-1,1'-biphenyl-4,4'-diamine, tetra-p-tolyl-biphenyl-4,4'-diamine, N,N-diphenyl-N,N'-bis(4-methoxyphenyl)-1,1-biphenyl-4,4'-diamine, N,N'-bis(4-butylphenyl)-N,N'-di-p-tolyl-[p-terphenyl]-4,4'-diamine, N,N'-bis(4-butylphenyl)-N,N'-di-m-tolyl-[p-terphenyl]-4,4'-diamine, N,N'-bis(4-butylphenyl)-N,N'-di-o-toly-[p-terphenyl]-4,4'-diamine, N,N'-bis(4-butylphenyl)-N,N'-bis-(4-isopropylphenyl)-[p-terphenyl]-4,4'-diamine, N,N'-bis(4-butylphenyl)-N,N'-bis-(2-ethyl-6-methylphenyl)-[p-terphenyl]-4,4'-diamine, N,N'-bis(4-butylphenyl)-N,N'-bis-(2,5-dimethylphenyl)-[p-terphenyl]-4,4'-diamine, and N,N'-diphenyl-N,N'-bis(3-chlorophenyl)[p-terphenyl]-4,4'-diamine, and wherein said thiobis(thioformate) is selected from the group consisting of O,O-diisopropyl dithiobis(thioformate), O,O-di(1-methylethyltrithiobis(thioformate), O,O-di(1-methylethyl)tetrathiobis(thioformate), O,O-di(1-methylethyl) pentathiobis(thioformate), O,O-diethyl dithiobis (thioformate), O,O-dimethyl dithiobis(thioformate), and starch dithiobis(thioformate).

20. A photoconductor in accordance with claim 1 wherein said charge transport component is represented by

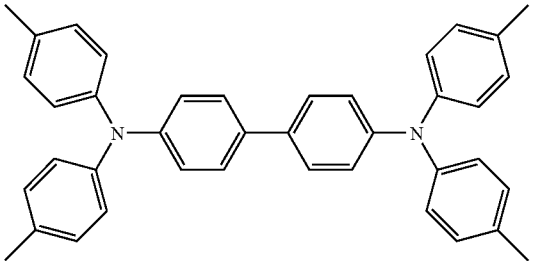
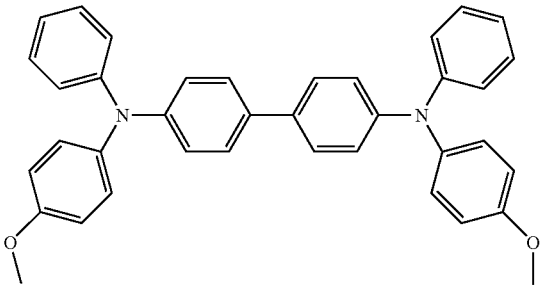
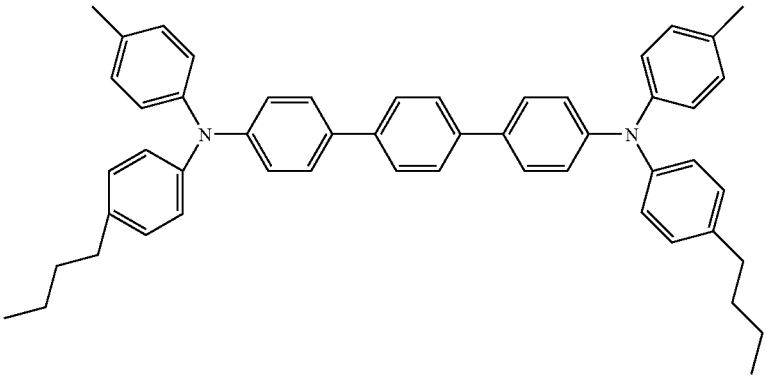
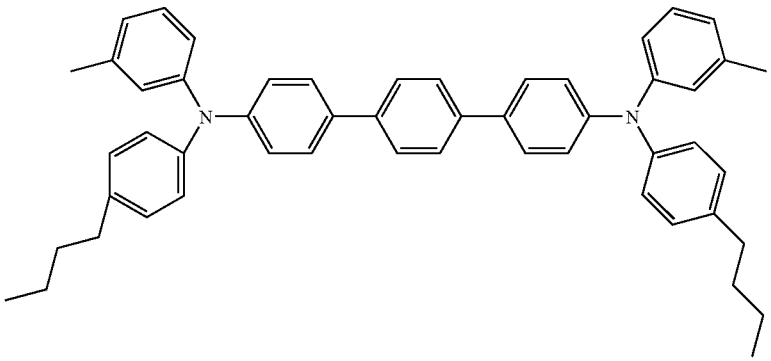
or
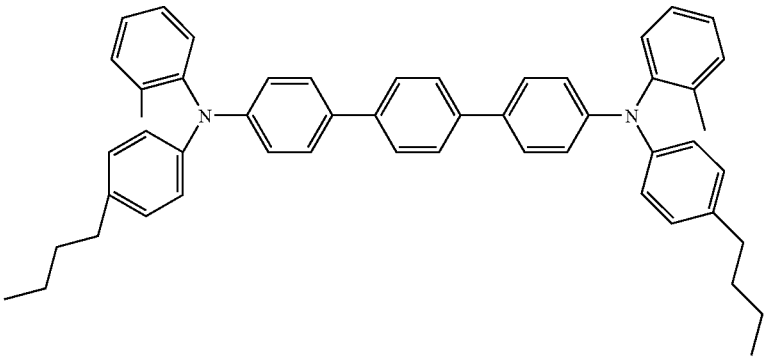

and wherein said thiobis(thioformate) is selected from the group consisting of at least one of O,O-diisopropyl dithiobis (thioformate), O,O-di(1-methylethyl)trithiobis(thioformate), O,O-di(1-methylethyl)tetrathiobis(thioformate), O,O-di(1-methylethyl)pentathiobis(thioformate), O,O-diethyl dithiobis(thioformate), O,O-dimethyl dithiobis(thioformate), and starch dithiobis(thioformate).

21. A photoconductor in accordance with claim 1 further including in at least one of said charge transport layers an antioxidant comprised of a hindered phenolic, a hindered amine, and mixtures thereof, and wherein said thiobis(thioformate), present in an amount of from about 0.2 to about 7 weight percent, is selected from the group consisting of at least one of O,O-diisopropyl dithiobis(thioformate), O,O-di (1-methylethyl) trithiobis(thioformate), O,O-di(1-methylethyl)tetrathiobis(thioformate), O,O-di(1-methylethyl)pentathiobis(thioformate), O,O-diethyl dithiobis(thioformate), O,O-dimethyl dithiobis(thioformate), and starch dithiobis (thioformate).

22. A photoconductor in accordance with claim 1 wherein said photogenerating layer is comprised of a photogenerating pigment or photogenerating pigments.

23. A photoconductor in accordance with claim 22 wherein said photogenerating pigment is comprised of at least one of a titanyl phthalocyanine, a hydroxygallium phthalocyanine, an alkoxygallium phthalocyanine, a halogallium phthalocyanine, a metal free phthalocyanine, a perylene, and mixtures thereof.

24. A photoconductor in accordance with claim 22 wherein said photogenerating pigment is comprised of a hydroxygallium phthalocyanine Type V, and wherein said thiobis(thioformate) is selected from the group consisting of at least one of O,O-diisopropyl dithiobis(thioformate), O,O-di(1-methylethyl) trithiobis(thioformate), O,O-di(1-methylethyl) tetrathiobis(thioformate), O,O-di(1-methylethyl)pentathiobis(thioformate), and O,O-diethyl dithiobis (thioformate).

25. A photoconductor in accordance with claim 1 further including a hole blocking layer, and an adhesive layer, and further containing a supporting substrate, and wherein said thiobis(thioformate) is selected from the group consisting of at least one of O,O-diisopropyl dithiobis(thioformate), , O,O-di(1-methylethyl)trithiobis(thioformate), O,O-di(1-methylethyl)tetrathiobis (thioformate), O,O-di(1-methylethyl)pentathiobis(thioformate), O,O-diethyl dithiobis(thioformate), O,O-dimethyl dithiobis(thioformate), and starch dithiobis (thioformate).

26. A photoconductor in accordance with claim 1 wherein said at least one charge transport layer is comprised of a top charge transport layer and a bottom charge transport layer, and wherein said top layer is in contact with said bottom layer, and said bottom layer is in contact with said photogenerating layer, and wherein said photoconductor further includes a supporting substrate.

27. A photoconductor in accordance with claim 1 wherein said thiobis(thioformate) is present in an amount of from about 0.2 to about 5 weight percent, and is O,O-diisopropyl dithiobis(thioformate).

28. A photoconductor comprising a supporting substrate, a photogenerating layer, and at least one charge transport layer;

and wherein said charge transport layer contains a thiobis (thioformate).

29. A photoconductor in accordance with claim 28 wherein said thiobis(thioformate) is represented by

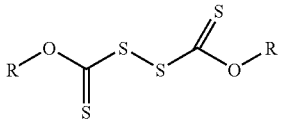

and wherein R is alkyl.

30. A photoconductor in accordance with claim 29 wherein said charge transport layer is comprised of N,N'-diphenyl-N,N-bis(3-methylphenyl)-1,1'-biphenyl-4,4'-diamine, tetra-p-tolyl-biphenyl-4,4'-diamine, or N,N'-diphenyl-N,N'-bis(4-methoxyphenyl)-1,1-biphenyl-4,4'-diamine.

31. A photoconductor in accordance with claim 28 wherein said thiobis(thioformate) present in an amount of from about 0.1 to about 2 weight percent is represented by

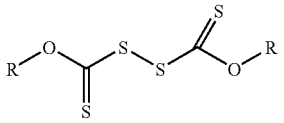

and wherein R is alkyl with from 1 to about 6 carbon atoms.

32. A photoconductor comprised in sequence of a supporting substrate, a photogenerating layer, and a charge transport layer;

and wherein said photogenerating layer contains a thiobis (thioformate).

* * * * *